United States Patent [19]

Dunn

[11] Patent Number: 4,842,755

[45] Date of Patent: Jun. 27, 1989

[54] MARINE LUBRICATING COMPOSITION

[75] Inventor: Adrian Dunn, Faringdon, United Kingdom

[73] Assignee: Exxon Chemical Patents Inc., Linden, N.J.

[21] Appl. No.: 10,227

[22] Filed: Feb. 3, 1987

[30] Foreign Application Priority Data

Feb. 4, 1986 [GB] United Kingdom ..... 8602627

[51] Int. Cl.[4] ..... C10M 105/32

[52] U.S. Cl. ..... 252/32.7 E; 252/42.7

[58] Field of Search ..... 252/32.7 E, 42.7

[56] References Cited

U.S. PATENT DOCUMENTS 3,254,025 5/1966 LeSuer ..... 252/515 A X
4,105,571 8/1978 Shaub ..... 252/51.5 A X
4,115,287 9/1978 Colelengh ..... 252/48.2
4,358,386 11/1982 Zoleski et al. ..... 252/32.7 E
4,386,001 5/1983 Zoleski et al. ..... 252/32.7 E
4,459,215 7/1984 Salentine ..... 252/32.7 E
4,517,104 5/1985 Bloch ..... 252/51.5 A

*Primary Examiner*—William R. Dixon, Jr.
*Assistant Examiner*—James M. Hunter, Jr.
*Attorney, Agent, or Firm*—J. B. Murray, Jr.

[57] ABSTRACT

Marine diesel cylinder lubricant composition comprising a major amount of an oil of lubricating viscosity and a borated dispersant; one or more overbased metal compounds and a zinc dialkyl dithiophosphate wherein the boron content of the oil is from 0.01 to 0.016 wt %, the zinc content of the oil is from 0.02 to 0.023 wt % and the TBN is at least, 60 given surprising wear results particular in cylinder liner and piston ring wear.

22 Claims, No Drawings

MARINE LUBRICATING COMPOSITION

BACKGROUND OF THE INVENTION

This invention relates to an improved lubricating oil composition which is particularly useful as a lubricant in marine applications and particularly as a marine cylinder lubricant (MDCL). More particularly, this invention relates to a finished lubricant formulation exhibiting improved ring wear and liner wear performance which employ certain amounts of borated dispersants and zinc compounds.

The present invention is based upon the discovery that the incorporation of certain amounts of borated dispersants such as polyisobutenyl succinic anhydride-polyamine borated derivatives into a lubricating oil composition in combination with certain amounts of zinc dialkyl dithiophosphate antiwear additives in MDCL formulations give surprising wear results particularly in cylinder liner and piston ring wear. Combinations of borated dispersants and zinc antiwear additives are known in lubricants for automobile engines, but have not been described in compositions suitable for marine diesels lubricants. GB Pat. No. 1054310 describes nitrogen- and boron-containing compositions comprising borated dispersants such as polyisobutenyl succinic anhydride - polyamine borated derivatives and their use in gasoline and diesel engines including use as MDCL. The use of such borated dispersants in combination with zinc dialkyl dithiophosphate antiwear additives in general is disclosed, but there is no disclosure of a combination of borated dispersant and zinc antiwear additive in a formulation having the viscosity and total base number appropriate for MDCL.

SUMMARY OF THE INVENTION

In accordance with the present invention, there is provided an improved lubricating oil composition for use in marine applications comprising a major amount of an oil of lubricating viscosity and:

(a) at least 0.5 wt % of a borated ashless dispersant;

(b) at least 12.1 wt % of one or more overbased metal compound as a detergent additive or a mixture thereof with neutral metal detergent additives, said overbased metal compound may be selected from soluble calcium, magnesium and barium sulphonates, phenates and sulphurized phenates, but overbased calcium sulphonates and phenates are preferred; and (c) at least 0.1 wt % of a zinc dialkyl dithiophosphate as an anti-wear additive, wherein the boron content of the composition is from 0.01 to 0.016 wt %, the zinc content of the composition is from 0.02 to 0.23 wt %, and the total base number (ASTM 2896) or TBN is at least 60, more usually at least 70.

It has been found that using the amounts of boron and zinc indicated provide a marine diesel cylinder lubricating oil composition exhibiting greatly improved wear performance and cleanliness.

DETAILED DESCRIPTION OF THE PREFERRED EMBODIMENTS

The lubricating oil compositions of this invention are used as MDCL lubricants for marine diesel engines. Thus, the compositions of the present invention achieve, through the use of the combination of dispersant and zinc antiwear additive, the highly desirable objective of providing a finished lubricating oil satisfying the relevant qualification tests and standards for marine diesel cylinder lubricating oil compositions.

The finished lubricating oil prepared as described above will preferably contain the following active ingredient percentages by weight: 1.5–5 percent by weight of the dispersant 12.25–30 weight per cent of overbased metal detergent and 0.1–0.5 weight per cent of zinc dihydrocarbyl dithiophosphate. The actual components of the finished oil may be added as additives or additive mixture in a diluent.

There may also be present in a finished oil small but effective amounts of other special purpose additives and these include anti-oxidants, anti-foamants, and rust inhibitors. These are additives whose functions are not directed to provide improvements in wear.

The preferred dispersants are the borated ashless polyalkenyl succinimide dispersants where the alkenyl group of the succinic acid or anhydride is derived from a polymer of a $C_3$ or $C_4$ monoolefin, especially a polyisobutylene wherein the polyisobutenyl group has a number average molecular weight (Mn) of from 700 to 5,000 more preferably from 900 to 2,500. Such dispersants preferably have at least 1, preferably 1 to 2, more preferably 1.1 to 1.8, succinic groups for each polyisobutenyl group.

Suitable polyamines for reaction with the aforesaid succinic acids or anhydrides to provide the succinimide are those polyalkyleneamines represented by the formula $$NH_2(CH_2)_n—(NH(CH_2)_n)_m—NH_2$$

wherein n is 2 to 3 and m is 0 to 10. Illustrative are ethylene diamine, diethylene trimaine, triethylene tetramine, tetraethylene pentamine, tetrapropylene pentamine, pentaethylene hexamine and the like, as well as the commercially available mixtures of such polyamines. The amines are reacted with the alkenyl succinic acid or anhydride in conventional ratios of about 1:1 to 10:1 moles of alkenyl succinic acid or anhydride to polyamine, and preferably in a ratio of about 2:1.

The borated alkenyl succinimide dispersants are also well known in the art as disclosed in U.S. Pat. No. 3,254,025. These derivatives are provided by treating the alkenyl succinimide with a boron compound selected from the group consisting of boron oxides, boron halides, boron acids and esters thereof, in an amount to provide from about 0.1 atomic proportion of boron to about 10 atomic proportions of boron for each atomic proportion of nitrogen in the dispersant.

The borated product will generally contain 0.1 to 2.0, preferably 0.2 to 0.8 weight per cent boron based upon the total weight of the borated dispersant. Boron is considered to be present as dehydrated boric acid polymers attaching as the metaborate salt of the imide. The boration reaction is readily carried out adding from about 1 to 3 weight per cent based on the weight of dispersant, of said boron compound, preferably boric acid, to the dispersant as a slurry in mineral oil and heating with stirring from 135° C. to 165° C. for 1 to 5 hours followed by nitrogen stripping filtration of the product.

The metal detergent additives suitable in the diesel oil formulations of the present invention are known in the art and include one or more members selected from the group consisting of overbased oil-soluble calcium, magnesium and barium phenates, sulphurised phenates, and sulphonates, especially the overbased calcium sulphurised phenates obtained from $C_9$ or $C_{12}$ alkyl phenols and sulphonates of $C_{16}$–$C_{50}$ alkyl substituted benzene or toluene sulphonic acids which have a total base number of from 200 to 500.

These overbased materials may be used as the sole metal detergent additive or in combination with the same additives in the neutral form but the overall metal detergent additive combination should have the same basicity as represented by the foregoing total base number. Preferably they are present in amounts of from 12.5 to 15 wt % with the aforementioned mixture of overbased calcium sulphurised phenate and calcium sulphonate being especially useful. The weight ratio of sulphonate to phenate is desirably from 1:1 to 15:1, preferably from 5:1 to 15:1, typically from 10:1 to 12:1.

The anti-wear additives useful are the oil-soluble zinc dihydrocarbyldithiophosphate having a total of at least 5 carbon atoms, the alkyl group being preferably $C_3$–$C_9$, typically used in amounts of 0.1–0.6 wt %.

While a wide variety of lubricating oil base stocks may be used in preparing the composition of this invention, most typically mineral oils having a viscosity of about 2–40 centistokes (ASTM-D-445) at 99° C. are employed preferably to give a finished lubricant with a viscosity meeting the requirements of SAE 50.

The invention is further illustrated by the following examples which are not to be considered as limitative of its scope. Percentages are by weight except where otherwise indicated.

EXAMPLES

MDCL formulations were prepared from solution concentrates prepared by blending dispersant, metal additives, and zinc antiwear additive, at 65° C. to form a homogeneous solution prior to diluting the concentrate to provide the finished lubricating oil.

Lubricating oil formulations of this invention were evaluated in the Abingdon B-1 engine test - details of which are given below:

| B-1 Engine Test Conditions | |
|---|---|
| Test Conditions (Total Test Duration is 113 hours) | |
| 1. BREAK-IN PERIOD (13 Hours) | |
| Fuel 0–1 hrs | 1% Sulphur Gas Oil |
| 1–13 hrs | Residual Fuel |
| Engine Speed | 350 rpm |
| 2. TEST PERIOD (100 hours) | |
| Fuel | Test Fuel Residual |
| Fuel Flow Rate | 120 = 1 Sec/Lb |
| Cylinder Oil Feed Rate | 6 g/hr |
| Engine Speed | 350 rpm |
| Engine Brake Load | Adjusted to Maintain Correct Fuel Flow Rate (Approx 66 66 bhp) |
| IMEP | 169 PsI (11.9 kg/cm$^2$) |
| BMEP | 139 PsI (9.8 kg/cm$^2$) |
| Scavenge Air Pressure | 8.0 PsI (0.6 kg/cm$^2$) |

| Mechanical Details of B-1 Engine | |
|---|---|
| Cylinder Bore | 8.0 in (203 mm) |
| Stroke | 10.75 in (273 mm) |
| Compression Ratio | 12.5:1 |
| Maximum Cylinder Pressure Allowable | 1900 lb/in$^2$ (134 kg/cm$^2$) |
| Scavenge System | Cylinder Port, Exhaust Valves In Head, End Scavenge |
| Operating Cycle | 2-stroke |
| Running speed maximum | 450 rev/min |

-continued

| Mechanical Details of B-1 Engine | |
|---|---|
| Mean indicated pressure maximum | 228 lb/in$^2$ (16 kg/cm$^2$) |
| Combustion chamber | Open without swirl aids |
| Fuel injection | Central single fuel valve |
| Fuel injection rate | 176 mm$^3$/Degree |
| Scavenge Air | Positive displacement compressor separately driven |
| Running line | Crosshead with diaphragm and piston rod |
| Cylinder lubrication | 4 quills in way of lower stroke; multi-point separately driven |
| Piston cooling | Solid oil by hollow piston rod |

The lubricating Oil Test Formulation detailed below were evaluated for diesel engine performance in the Abingdon B-1 engine.

| Test Formulations, weight per cent | | | | |
|---|---|---|---|---|
| Component | A | B | C | Component (wt %) D |
| Non-borated dispersant | 3.92 | 3.92 | 0 | 0 |
| Borated dispersant | 0 | 0 | 3.92 | 3.92 |
| Detergent | 23.38 | 23.38 | 23.38 | 23.38 |
| Antiwear | 0 | 0.28 | 0.28 | 0.56 |
| Base Oil | 72.70 | 72.42 | 72.42 | 72.14 |

The borated dispersant was an oil solution containing 51.5 wt % of a borated polyisobutenyl succinic anhydride-polyamine reaction product containing 1.27 succinic groups per polyisobutenyl group in which the polyisobutenyl group had a number average molecular weight (Mn)=900 and a boron content of 7.7 wt %. The non-borated dispersant was similar but contained no boron.

The detergent was a mixture of an overbased calcium sulphonate additive and an overbased calcium sulphurised phenate additive. The overbased calcium sulphonate additive comprised 21% of the formulation and was an oil solution comprising 54% of active ingredient and having a TBN of 300. The overbased calcium phenate additive comprised 2.38% of the formulation and was an oil solution comprising 67% of active ingredient and having a TBN of 250. The antiwear additive was an oil solution comprising 90wt % of zinc diisooctyl dithiophosphate.

Formulation A and B contained no boron, A also contained no zinc. The boron content of formulation C was 0.014 wt % and the zinc content was 0.022 wt %. The boron content of formulation D was 0.014 wt % and the zinc content was 0.044 wt %. Formulation C was an example of the invention.

The results obtained in the Abingdon B-1 engine test are set out below:

| Formulation | Total ringwear gm/1000 hrs | Average liner wear mm/1000 hrs |
|---|---|---|
| Reference oil | 125.4 | 0.68 |
| A | 128.7 | 0.85 |
| B | 129.4 | 0.87 |
| C* | 100.1 | 0.68 |
| D | 122.4 | 0.87 |

*average of three repeats

As compared with comparative formulations A and B, formulation C gives a significant reduction in both ring and liner wear, whereas formulation D shows that increased zinc content results in a loss in performance benefits.

I claim:

1. A marine diesel cylinder lubricant composition comprising a major amount of an oil of lubricating viscosity and (a) at least 0.5 wt % of a borated ashless dispersant;

(b) at least 12.1 wt % of one or more overbased metal compounds; and (c) at least 0.1 wt % of a zinc dialkyl dithiophosphate, wherein the boron content of the lubricant composition is from 0.01 to 0.016 wt %, the zinc content of the lubricant composition is from 0.02 to 0.023 wt % and the TBN is at least 60.

2. The composition of claim 1, which is an SAE 50 lubricant.

3. The composition of claim 1, wherein the lubricant composition contains from 1.5 to 5 wt % of the borated dispersant.

4. The composition of claim 3, wherein the dispersant is a borated polyisobutenyl succinic anhydride polyalkylene amine reaction product, the polyisobutenyl moiety having a Mn of from 900 to 2,500.

5. The composition of claim 1, wherein the lubricant composition contains from 12.25 to 30 wt % of overbased metal compound.

6. The composition of claim 5, in which the overbased metal compound is a mixture of overbased calcium sulphonate and overbased calcium sulphurised phenate.

7. The composition of claim 6, in which the weight ratio of sulphonate to phenate is from 1:1 to 15:1.

8. The composition of claim 1, wherein there is present from 0.1 to 0.6 wt % of zinc dialkyldithiophosphate, the alkyl having from 3–9 carbon atoms.

9. The composition of claim 1, wherein the lubricant composition has a TBN of at least 70.

10. A marine diesel cylinder lubricant composition comprising a major amount of a mineral oil having a viscosity of about 2–40 centistokes at 99° C. and (a) at least 0.5 wt % of a borated ashless dispersant;

(b) at least 12.1 wt % of one or more overbased metal compound detergent additives; and (c) at least 0.1 wt % of a zinc dihydrocarbyl dithiophosphate antiwear additive, wherein the boron content of the lubricant composition is from 0.01 to 0.016 wt %, the zinc content of the lubricant composition is from 0.02 to 0.023 wt % and is characterized by a total base number of at least 60.

11. The composition of claim 9, which is an SAE 50 lubricant.

12. The composition of claim 10, wherein the lubricant composition contains from 1.5 to 5 wt % of the borated dispersant.

13. The composition of claim 12, wherein the dispersant comprises a borated polyisobutenyl succinic anhydride polyalkylene amine reaction product, the polyisobutenyl moiety having a number average molecular weight of from 900 to 2,500.

14. The composition of claims 10 or 13, wherein the lubricant composition contains from 12.25 to 30 wt % of overbased metal compound.

15. The composition of claim 14, in which the overbased metal compound comprises a mixture of overbased calcium sulphonate and overbased calcium sulphurized phenate.

16. The composition of claim 15, in which the weight ratio of sulphonate to phenate is from 1:1 to 15:1.

17. The composition of claim 10, wherein there is present from 0.1 to 0.6 wt % of zinc dihydrocarbyldithiophosphate, wherein said hydrocarbyl group comprises alkyl having from 3–9 carbon atoms.

18. The composition of claim 17, wherein the lubricant composition has a total base number of at least 70.

19. The composition of claim 10 wherein said zinc dialkyldithiophosphate is present in an amount of from about 0.1 to 0.5 wt %.

20. The composition of claim 18 wherein said overbased metal compound is a mixture of overbased calcium sulfonate and overbased calcium sulfurized phenate.

21. The composition of claim 20 wherein the weight ratio of sulfonate to phenate is from 5:1 to 15:1.

22. The composition of any of claims 17–21 wherein the dispersant comprises a borated polyisobutenyl succinic anhydride polyalkylene amine reaction product, the polyisobutenyl moiety having a number average molecular weight of from 900 to 2,500.

* * * * *